United States Patent [19]

Nitta

[11] Patent Number: 4,838,459

[45] Date of Patent: Jun. 13, 1989

[54] AEROSOL STRUCTURE

[75] Inventor: Tomio Nitta, Kanagawa, Japan

[73] Assignee: Tokai Corporation, Kanagawa, Japan

[21] Appl. No.: 146,156

[22] Filed: Jan. 20, 1988

[30] Foreign Application Priority Data

Mar. 10, 1987 [JP] Japan ..... 62-33814[U]

[51] Int. Cl.[4] ..... B67D 5/52

[52] U.S. Cl. ..... 222/136; 222/402.1; 239/304

[58] Field of Search ..... 222/402.24, 402.25, 222/402.1, 394, 136, 135, 94, 129, 132, 144.5; 239/302, 304, 305

[56] References Cited

U.S. PATENT DOCUMENTS

| | | | |
|---|---|---|---|
| 3,372,844 | 3/1968 | Kitabayashi | 222/402.1 |
| 3,424,353 | 1/1969 | Meader et al. | 222/402.1 |
| 3,722,750 | 3/1973 | Fox, Jr. | 222/136 |

FOREIGN PATENT DOCUMENTS

| | | | |
|---|---|---|---|
| 1179892 | 2/1970 | United Kingdom | 222/402.1 |

*Primary Examiner*—Joseph J. Rolla
*Assistant Examiner*—Kenneth Noland
*Attorney, Agent, or Firm*—Armstrong, Nikaido, Marmelstein, Kubovcik & Murray

[57] ABSTRACT

Disclosed is an improved aerosol structure whose partition-walls have passages in the vicinity of the bottom of container, thereby permitting its compartments to communicate with each other. In use the liquid under pressure is supplied to the outlet of aerosol from all compartments until they have been completely exhausted. The bottomless aerosol body and bottom closure are made of synthetic resin. Advantageously the bottom closure may be made of a transparent synthetic resin, thereby permitting a check on the remaining amount of liquid in the container.

5 Claims, 2 Drawing Sheets

AEROSOL STRUCTURE

BACKGROUND OF THE INVENTION

1. Field of the Invention

The present invention relates to a container from which liquid medicine, liquid cosmetic, liquid chemicals and other liquid can be forced out in the form of fine mist. Specifically, such container contains liquid along with gas at an increased pressure, and is capable of forcing out such liquid in the form of fine mist by opening an associated valve. Such container is referred to as "aerosol" hereinafter and in the claims.

2. Related Arts

FIG. 4 shows a conventional aerosol as comprising a metal pressure container 1, a mount 4 put in the top opening of the container 1, a top closure 3 hermetically clamped to the top opening of the container 1 and 1 cap nozzle 9. As shown, the mount 4 holds an ejection rod 5, an annular gasket 6 and a spring 7. Specifically, the ejection rod 5 has a central longitudinal hole and a lateral hole communicating with the central longitudinal hole and opening out on the side of the rod 5. The cap nozzle 9 is fixed to the top end of the ejection rod 5. The spring 7 raises the ejection rod 5 all the time, and in this position the annular gasket 6 around the ejection rod 5 closes the lateral hole of the ejection rod 5. The valve assembly 8 thus constructed can be opened by pushing down the cap nozzle 9. Specifically, when the cap nozzle 9 is lowered against the resilient force of the spring 7, the annular gasket 6 is yieldingly bent to open the lateral hole of the ejection rod 5, thereby permitting the ejection of the liquid from the cap nozzle 9 through the lateral and longitudinal holes of the ejection rod 5.

This conventional aerosol is composed of many parts, and accordingly assemblage of the parts into an aerosol requires many steps. As a result the manufacturing cost is disadvantageously high. In an attempt to reduce the manufacturing cost an aerosol using a container of synthetic resin as shown in FIG. 5 has been proposed. In the drawing a container 11 of synthetic resin has a mount closure 12 hermetically sealed to the opening of the container 11. The mount closure 12 has a valve 13 built therein, and an elongated tube 14 extends down from the mount closure 12. As a matter of course the capacity of container 11 increases with the physical size of the container. A plurality of compartments are formed in the inside of such enlarged container to increase its pressure-resistivity.

As is well understood, the sucking tube is long enough to reach the bottom of the container; otherwise the liquid could not be forced out to the last drip. In an aerosol having a plurality of compartments, however, the liquid can be forced out to the last drip in a selected compartment in which the sucking tube extends to the bottom of the compartment, but the liquid cannot be completely sucked in the other compartments, thus allowing an appreciable quantity of liquid to remain in the container.

SUMMARY OF THE INVENTION

One object of the present invention is to provide an aerosol which is capable of forcing out liquid to the last drip.

Another object of the present invention is to provide such an aerosol assuring the stable ejection of liquid to the last drip in the form of fine mist.

To attain these objects an aerosol according to the present invention has a plurality of compartments communicating with each other through passages formed in their partition-walls in the vicinity of the bottom of the container.

An aerosol according to the present invention comprises a container having a plurality of longitudinal compartments around a central longitudinal space, the central longitudinal space being defined by its surrounding wall, and each of the longitudinal compartments being defined by longitudinal walls integrally connected to the surrounding wall of the central longitudinal space and to the inner surface of the container, the bottom edge of the surrounding wall of the central longitudinal space being partly short of the bottom of the container to define passages which communicate the compartments with the central longitudinal space; a top closure hermetically sealed to the top opening of the container, the top closure having a central reentrancy and a longitudinal hole communicating with the central reentrancy; a spring-biased ejection rod having a longitudinal hole and a lateral hole communicating with the longitudinal hole and opening out on the side of the ejection rod, the ejection rod being snugly accommodated in the central reentrancy of the top closure; an annular gasket fixed to the ejection rod at the level at which the lateral hole of the ejection rod opens, thereby permitting the gasket to close the lateral hole while the ejection rod is spring-biased to its upper closing position; a cap nozzle fixed to the top end of the ejection rod, the cap nozzle having a hole communicating withe the longitudinal hole of the ejection rod and opening out on the side of the cap nozzle; an elongated tube connected to the longitudinal hole of the top closure and extending down to the bottom of the container; and a bottom closure hermetically sealed to the bottom opening of the container.

The container is a mold of synthetic resin, and advantageously the bottom closure may have a central reentrancy to communicate with the compartments through the passages of the surrounding wall, and the elongated tube is long enough to reach the re-entrancy of the bottom closure. The bottom closure may be advantageously of a transparent synthetic resin, thereby permitting a check on the remaining amount of the contained liquid.

In use the cap nozzle is pushed down to lower the ejection rod against the resilient force of the spring. Then, the annular gasket is yieldingly bent to allow the rising liquid in the elongated tube to enter the lateral and longitudinal holes of the ejection rod, and finally the liquid is forced out from the cap nozzle in the form of fine mist. While spraying, the liquid under pressure is supplied from the compartments to the central longitudinal space through the passages of the surrounding wall in the vicinity of the bottom of the container until these compartments have been completely exhausted. The passages can be easily formed by using notched partition-walls and a bottom closure, which is hermetically sealed to the bottom opening of the container in the opposing relationship with the notched portions of the partition-walls.

Other objects and advantages of the present invention will be better understood from the following description of an aerosol according to a preferred embodiment of the present invention, which is shown in the accompanying drawings:

PREFERRED EMBODIMENT OF THE INVENTION

Figure 1:
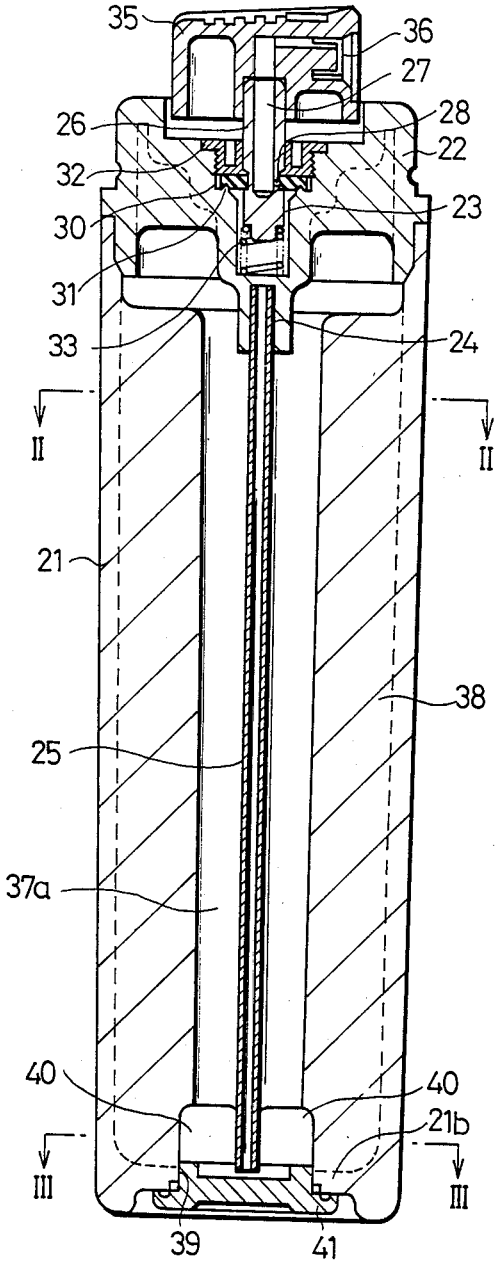
FIG. 1 is a longitudinal section of an aerosol according to a preferred embodiment of the present invention.
Figure 2:
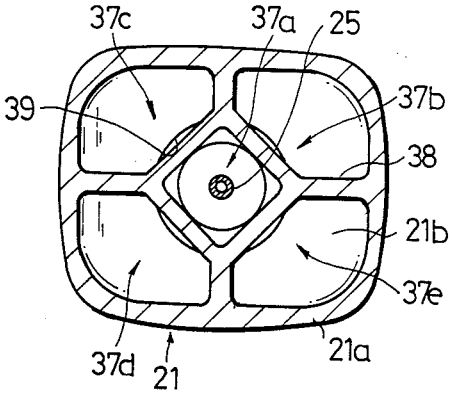
FIG. 2 is a cross section taken along the line II—II in FIG. 1.
Figure 3:
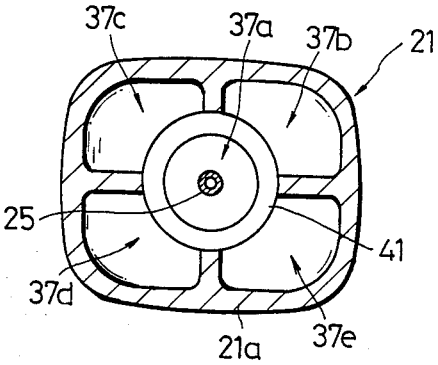
FIG. 3 is a cross section taken along the line III—III in FIG. 1.
Figure 4:
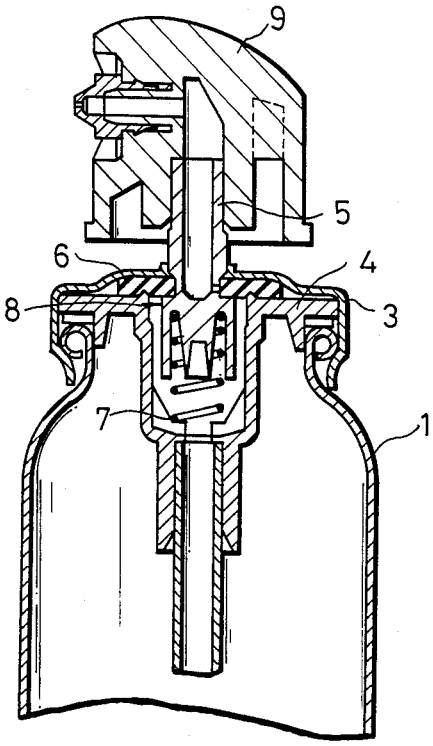
FIG. 4 PRIOR ART
FIG. 4 is a longitudinal section of an upper part of a conventional aerosol.
Figure 5:
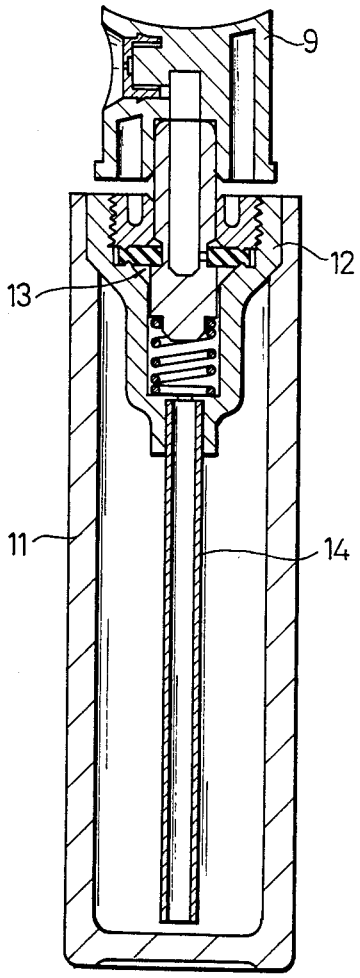
FIG. 5 PRIOR ART
FIG. 5 is a longitudinal section of another conventional aerosol.

Referring to FIGS. 1 to 3, an aerosol according to a preferred embodiment is shown as comprising a container 21 of synthetic resin having a plurality of longitudinal compartments 37*b* to 37*e* around a central longitudinal space 37*a;* a top closure 22 of synthetic resin hermetically sealed to the top opening of the container 21; a spring-biased ejection rod 26 having a longitudinal hole 27 and a lateral hole 28 communicating with the longitudinal hole 27 and opening out on the side of the ejection rod 26; a cap nozzle 35 fixed to the top end of the ejection rod 26; an elongated tube 25 connected to the top closure 22; and a bottom closure 41 hermetically sealed to the bottom opening of the container 21. Advantageously the top and bottom closures 22 and 41 may be hermetically sealed to the top and bottom openings of the container 21 by supersonic welding.

As shown, the central longitudinal space 37*a* is defined by its surrounding wall, and each longitudinal compartment is defined by longitudinal walls which are integrally connected to the surrounding wall of the central longitudinal space 37*a* and to the inner surface 21*a* of the container 21. The bottom edge of the surrounding wall of the central longitudinal space 37*a* are partly short of the bottom of the container 21 to define passages 40 which communicate the compartments 37*b* to 37*e* with the central longitudinal space 37*a*. The top closure 22 has a valve chamber 23 in the form of central reentrancy and a longitudinal hole 24 communicating with the central reentrancy 23. An elongated tube 25 is inserted in the longitudinal hole 24. The ejection rods 26 is snugly accommodated in the central reentrancy of the top closure 22. An annular gasket 30 is pinched between small projections 31 and an annular screw stopper 32. Thus, the gasket 30 is fitted in the circumferential groove of the ejection rod 26 at the level at which the lateral hole 28 of the ejection rod 26 opens out, thereby permitting the gasket 30 to close the lateral hole 28 while the ejection rod 26 is raised by a spring 33 to its upper closing position. As shown in FIG. 1, the spring 33 is put in the central reentrancy 23 to apply its resilient force to the bottom end of the ejection rod 26. The cap nozzle 35 has an outlet 36 for liquid, and it is detachably fixed to the top end of the ejection rod 35 with its channel communicating with the longitudinal hole 27 of the ejection rod 26. In operation the liquid is forced out from the outlet 36 of the cap nozzle 35 in the from of fine mist.

As shown in FIG. 2, partition-walls 38 are integrally connected to the inside surface 21*a* of the container 21 to define a central longitudinal space 37*a* and four surrounding compartments 37*b* to 37*e*. Also as shown in FIGS. 1 and 2, the bottom opening 39 of the container 21 is large enough to cover the central space 37*a* and adjacent sectors of the surrounding compartments 37*b* to 37*e*. The bottom edges of selected partition-walls have passages 40 in the sector areas of the bottom opening 39 of the container 21, and a bottom closure 41 of synthetic resin is fitted in and hermetically sealed to the bottom opening 39 of the container 21 by supersonic welding. Thus, the central space and compartments communicate with each other by the passages 40. Advantageously, the bottom closure 41 is made of a transparent synthetic resin, thereby permitting a check on the remaining amount of liquid.

In making a synthetic resin container 21, a male core of the same shape and size as the partition-walls is put in a female mold of the same shape and size as the container, and then molten synthetic resin is poured into the mold. Thus, the bottomless container results. Then, a bottom closure 41 is fitted in and hermetically sealed to the bottom opening of the container by ultrasonic welding.

As shown in FIG. 1, the ejection rod 26 is raised by the spring 33 to its upper position, in which position the gasket 30 closes the lateral hole 28 of the ejection rod 26. In use when the cap nozzle 35 is pushed down against the resilient force of the spring 33, the gasket 30 is caught by the circumferential groove of the ejection rod 26, and is yieldingly bent to open the lateral hole 28 of the ejection rod 26, thereby forcing liquid out from the outlet 36 of the cap nozzle 35 in the form of fine mist.

Thanks to the passages 40 formed on the bottom edges of selected partition-walls the liquid can be forced out to the last drip in a stable way. A synthetic resin bottomless container having partition-walls notched on their bottom edge and a synthetic resin bottom closure are used to make up an aerosol body. This arrangement makes it easy to form passages in selected partition-walls to communicate the compartments with each other in the container.

What is claimed is:

1. An improved aerosol structure comprising:

(a) a container having a plurality of longitudinal compartments disposed around a central longitudinal space, the central longitudinal space being defined by its surrounding wall, and each of the longitudinal compartments being defined by longitudinal walls integrally connected to the surrounding wall of the central longitudinal space and to the inner surface of the container, portions of the bottom edge of the central longitudinal space terminating short of the bottom of the container to define passages to allow intercommunication between the compartments and the central longitudinal space;

(b) a top closure hermetically sealed to a top opening of the container, said top closure having a central reentrancy and a longitudinal hole communicating with the central reentrancy;

(c) a spring-biased ejection rod having a longitudinal hole and a lateral hole communicating between said longitudinal hole and opening out on the side of the ejection rod, the ejection rod being snugly accommodated in said central reentrancy;

(d) an annular gasket fixed to the ejection rod at the level at which the lateral hole of the ejection rod opens thereby permitting the gasket to close the lateral hole while the ejection rod is spring-biased to its upper closing position;

(e) a cap nozzle fixed to a top of the ejection rod, the cap nozzle having a hole communicating with the longitudinal hole of the ejection rod and opening out on the side of the cap nozzle;

(f) an elongated tube communicating between the longitudinal hole of the top closure and extending down to the bottom of the central longitudinal space in the region of the passages intercommunicating with the longitudinal compartments and the central longitudinal space; and (g) a bottom closure hermetically sealed to a bottom opening of the container for charging said container with a gas under pressure.

2. An aerosol structure according to claim 1 wherein the container is made of molded synthetic resin.

3. An aerosol structure according to claim 1 or claim 2 wherein the bottom closure has a central reentrancy to communicate with the plurality of longitudinal compartments and the central longitudinal space with the elongated tube being long enough to reach the reentrancy of the bottom closure.

4. An aerosol structure according to claim 3 wherein the bottom closure is made of a transparent synthetic resin.

5. An aerosol structure according to claims 1 or 2 wherein the bottom closure is made of a transparent synthetic resin.

* * * * *